US011319840B2

(12) United States Patent
Van Wingerden et al.

(10) Patent No.: US 11,319,840 B2
(45) Date of Patent: May 3, 2022

(54) DEACTIVATING ROCKER ARM HAVING TWO-STAGE LATCH PIN

(71) Applicant: Eaton Intelligent Power Limited, Dublin (IE)

(72) Inventors: Mark Van Wingerden, Battle Creek, MI (US); Douglas J. Nielsen, Marshall, MI (US)

(73) Assignee: Eaton Intelligent Power Limited, Dublin (IE)

( * ) Notice: Subject to any disclaimer, the term of this patent is extended or adjusted under 35 U.S.C. 154(b) by 0 days.

(21) Appl. No.: 17/267,451

(22) PCT Filed: Aug. 7, 2019

(86) PCT No.: PCT/EP2019/025261

§ 371 (c)(1),
(2) Date: Feb. 9, 2021

(87) PCT Pub. No.: WO2020/030298

PCT Pub. Date: Feb. 13, 2020

(65) Prior Publication Data

US 2021/0324768 A1 Oct. 21, 2021

Related U.S. Application Data

(60) Provisional application No. 62/716,712, filed on Aug. 9, 2018.

(51) Int. Cl.
*F01L 1/18* (2006.01)
*F01L 1/047* (2006.01)
(Continued)

(52) U.S. Cl.
CPC ..... *F01L 1/18* (2013.01); *F01L 1/047* (2013.01); *F01L 1/181* (2013.01); *F01L 1/46* (2013.01);
(Continued)

(58) Field of Classification Search
CPC ..... F01L 1/181; F01L 2001/186; F01L 1/46; F01L 13/0005
(Continued)

(56) References Cited

U.S. PATENT DOCUMENTS 6,000,374 A 12/1999 Cosma et al.
6,769,387 B2 8/2004 Hayman et al.
(Continued)

FOREIGN PATENT DOCUMENTS

CN 103388504 B 3/2016
CN 107701253 A 2/2018
(Continued)

OTHER PUBLICATIONS

International Search Report and Written Opinion for PCT/EP2019/025261, dated Oct. 22, 2019; pp. 1-11.

*Primary Examiner* — Jorge L Leon, Jr.
(74) *Attorney, Agent, or Firm* — Mei & Mark, LLP

(57) ABSTRACT

A rocker arm assembly comprises a valve side rocker arm portion, a cam side rocker arm portion configured to selectively rotate relative to the valve side rocker arm portion, and a latch pin assembly disposed in the valve side rocker arm portion and in the cam side rocker arm portion. Portions of the latch pin assembly are configured to move so that when the cam side rocker arm portion selectively rotates, the valve side rocker arm portion switches among a full lift mode, a partial lift mode, and a lost motion lift mode.

18 Claims, 11 Drawing Sheets

(51) Int. Cl.

| | |
|---|---|
| ***F01L 1/46*** | (2006.01) |
| ***F01M 9/10*** | (2006.01) |
| ***F01M 11/02*** | (2006.01) |
| ***F01L 13/00*** | (2006.01) |

(52) U.S. Cl.
CPC ..... *F01L 13/0005* (2013.01); *F01M 9/10* (2013.01); *F01M 11/02* (2013.01); *F01L 2001/186* (2013.01); *F01L 2810/02* (2013.01)

(58) Field of Classification Search
USPC ..... 123/90.44
See application file for complete search history.

(56) References Cited

U.S. PATENT DOCUMENTS

| | | | | |
|---|---|---|---|---|
| 7,210,435 | B2 | 5/2007 | Decur, Jr. | |
| 7,673,602 | B2 | 3/2010 | Masegi | |
| 7,827,944 | B2 | 11/2010 | Pierik | |
| 8,056,523 | B2 | 11/2011 | Ha et al. | |
| 8,365,691 | B2 | 2/2013 | Methley | |
| 8,550,047 | B2 | 10/2013 | Odell et al. | |
| 8,851,048 | B2 | 10/2014 | Meistrick | |
| 9,115,654 | B2 | 8/2015 | Schnell | |
| 2002/0195072 | A1 | 12/2002 | Spath et al. | |
| 2005/0188930 | A1* | 9/2005 | Best | F01L 1/181 123/90.16 |
| 2006/0236968 | A1* | 10/2006 | Falkowski | F01L 13/0036 123/90.39 |
| 2008/0083385 | A1* | 4/2008 | Han | F01L 1/267 123/90.16 |
| 2008/0271693 | A1* | 11/2008 | Edelmayer | F01L 1/22 123/90.44 |
| 2014/0182539 | A1* | 7/2014 | Gron, Jr | F01L 13/0015 123/182.1 |
| 2016/0160708 | A1 | 6/2016 | Choi et al. | |
| 2017/0009610 | A1* | 1/2017 | Ahmed | F01L 1/2405 |
| 2017/0145876 | A1* | 5/2017 | Pham | F01L 13/0036 |
| 2017/0198610 | A1* | 7/2017 | Haefner | F01L 13/0005 |
| 2017/0284313 | A1* | 10/2017 | Shewell | F01L 1/2416 |

FOREIGN PATENT DOCUMENTS

| | | | | |
|---|---|---|---|---|
| DE | 4025569 | C1 | 7/1991 | |
| DE | 102004005594 | A1 | 8/2005 | |
| DE | 102008059207 | A1 | 6/2010 | |
| EP | 1712748 | B1 | 4/2010 | |
| EP | 3029283 | A1 | 6/2016 | |
| FR | 2990483 | A1 * | 11/2013 | F01L 13/0005 |
| GB | 2333322 | A | 7/1999 | |
| WO | WO-2020/030298 | A1 | 2/2020 | |

* cited by examiner

DEACTIVATING ROCKER ARM HAVING TWO-STAGE LATCH PIN

This is a § 371 National Stage Entry of Patent Cooperation Treaty Application No. PCT/EP2019/025261, filed Aug. 7, 2019 which claims the benefit of U.S. provisional application No. 62/716,712, filed Aug. 9, 2018, all of which are incorporated herein by reference.

FIELD

The present disclosure relates generally to a rocker arm assembly for use in a valve train assembly and more particularly to a rocker arm assembly having a mechanical latch pin for a deactivating rocker arm assembly capable of full lift, partial lift, or no lift.

BACKGROUND

Many internal combustion engines utilize rocker arms to transfer rotational motion of cams to linear motion appropriate for opening and closing engine valves. Deactivating rocker arms incorporate mechanisms that allow for selective activation and deactivation of the rocker arm. In a deactivated state, the rocker arm may exhibit lost motion movement. In order to return to an activated state from a deactivated state, the mechanism may require that the rocker arm be in a particular position or within a range of positions that may not be readily achieved while undergoing certain unconstrained movement while in the deactivated state, such as during excessive lash adjuster pump-up.

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

SUMMARY

The methods disclosed herein overcome the above disadvantages and improves the art by way of a rocker arm assembly comprising a valve side rocker arm portion, a cam side rocker arm portion configured to selectively rotate relative to the valve side rocker arm portion, and a latch pin assembly disposed in the valve side rocker arm portion and in the cam side rocker arm portion. Portions of the latch pin assembly are configured to move so that when the cam side rocker arm portion selectively rotates, the valve side rocker arm portion switches among a full lift mode, a partial lift mode, and a lost motion lift mode.

The latch pin assembly comprises a primary latch pin assembly disposed in the valve side rocker arm portion opposite a secondary latch pin assembly disposed in the cam side rocker arm portion. The valve side rocker arm portion comprises a primary oil control cavity in a valve side body, and the primary latch pin assembly is configured to telescope in and out of the primary oil control cavity. The primary latch pin assembly comprises a first primary pin nested in a channel of the primary oil control cavity and a second primary pin nested in a channel of the first primary pin. The valve side body comprises an oil channel configured to supply oil pressure to the primary oil control cavity. A first biasing member is configured to bias the second primary pin out of the first primary pin.

The cam side rocker arm portion comprises a secondary oil control cavity in a cam side body, and the secondary latch pin assembly is configured to telescope in and out of the secondary oil control cavity. The secondary latch pin assembly comprises a first secondary pin nested in a channel of the secondary oil control cavity and a second secondary pin nested in a channel of the first secondary pin. The cam side body comprises an oil channel configured to supply oil pressure to the secondary oil control cavity. The oil channel in the valve side body is configured to supply oil pressure to the oil channel in the cam side body. A second biasing member is configured to bias the first secondary pin out of the cam side rocker arm portion. The valve side rocker arm portion comprises a rim around the primary latch pin assembly, and the secondary latch pin assembly is configured to telescope out of the cam side rocker arm portion and into the rim. A portion of the secondary latch pin assembly is configured to telescope out of the cam side rocker arm portion and into a portion of the primary latch pin assembly.

The rocker arm assembly can be configured wherein the cam side rocker arm portion comprises a secondary oil control cavity in a cam side body, wherein the secondary latch pin assembly comprises a first secondary pin nested in a channel of the secondary oil control cavity and a second secondary pin nested in a channel of the first secondary pin, and wherein the second secondary pin is configured to telescope out of the channel of the first secondary pin and into the channel of the first primary pin.

The cam side rocker arm portion can be configured to pivot past the valve side rocker arm portion when the primary latch pin assembly opposes the secondary latch pin assembly in the lost motion lift mode.

Additional objects and advantages will be set forth in part in the description which follows, and in part will be obvious from the description, or may be learned by practice of the disclosure. The objects and advantages will also be realized and attained by means of the elements and combinations particularly pointed out in the appended claims.

It is to be understood that both the foregoing general description and the following detailed description are exemplary and explanatory only and are not restrictive of the claimed invention.

DETAILED DESCRIPTION

Reference will now be made in detail to the examples which are illustrated in the accompanying drawings. Directional references such as "left" and "right" are for ease of reference to the figures.

Figure 1:
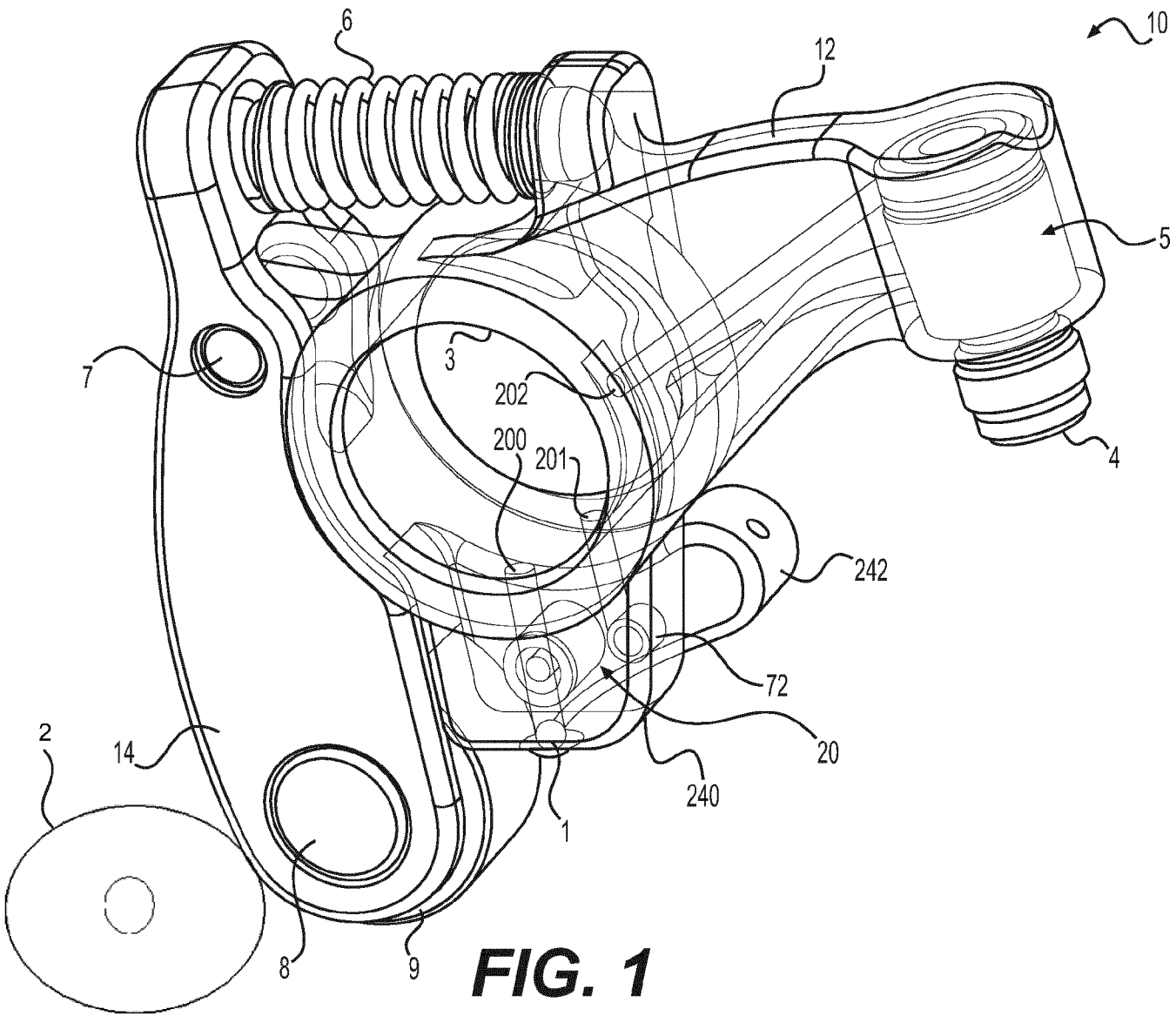
FIG. 1 is a perspective view of a rocker arm assembly having a latch pin assembly constructed in accordance to one example of the present disclosure.

With reference to FIG. 1, a rocker arm assembly 10 is shown to include a valve side rocker arm portion 12 and a cam side rocker arm portion 14. A latch pin assembly 20 moves between various positions to achieve different operating conditions. The latch pin assembly 20 operates as a mechanical latch pin for a deactivating the rocker arm assembly 10. In this regard, the rocker arm assembly 10 is capable of full lift, partial lift, or no lift.

The rocker arm assembly 10 is shown as a type III, center pivot. It can comprise a roller bearing 9 on a bearing axis 8 for interfacing with a cam rail. A cam lobe on the cam rail can impart a valve lift profile to the rocker arm assembly 10. A tappet interface can substitute for the roller bearing 9 and bearing axis 8.

The cam side rocker arm portion 14 and the valve side rocker arm portion 12 can pivot with respect to one another around a pivot axle 7. Or, the pivot location for the cam side rocker arm portion 14 and the valve side rocker arm portion 12 can be shared about the rocker shaft bore 3, as by extending the material of the cam side rocker arm portion 14 around the rocker shaft bore and eliminating the pivot axle 7.

A spring 6 can be biased between the cam side rocker arm portion 14 and the valve side rocker arm portion 12. The spring can enable lost motion valve lift profiles, including zero lift profiles, as described more below, when the latch pin assembly 20 is configured for lost motion.

The valve side rocker arm portion 12 can comprise a variety of additional aspects such as a lash adjuster, deactivating capsule, engine brake capsule, among others as by an insert 5. An engine valve stem can connect directly or indirectly at an elephant foot (e-foot) 4 or the like, and valve bridges and other valve connections can be used.

Figure 2:
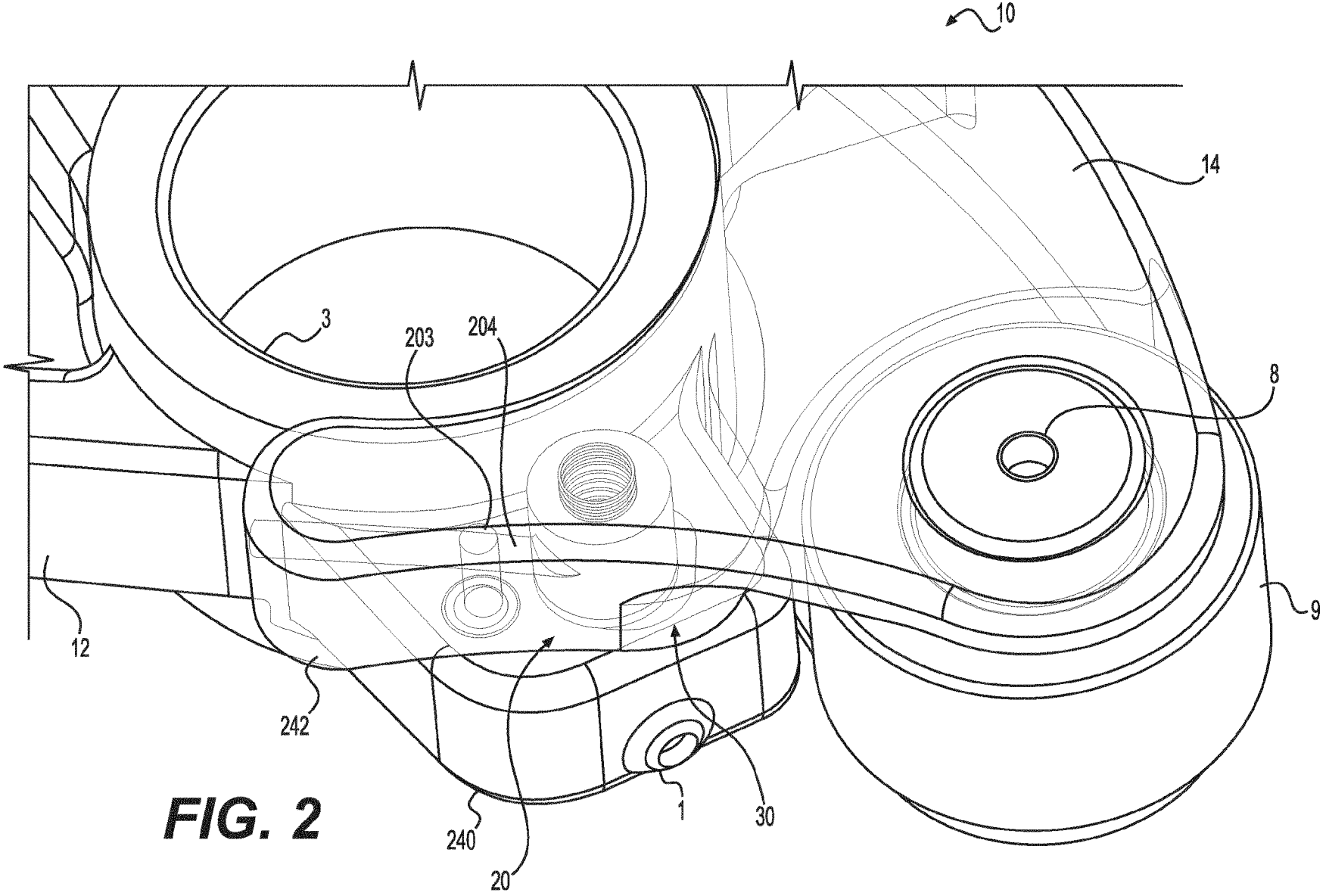
FIG. 2 is a perspective view of the latch pin assembly of the rocker arm assembly of FIG. 1.

The rocker shaft bore 3 can couple to a rocker shaft and the rocker shaft can be configured to supply pressurized control fluid to the rocker arm assembly 10. Then, internal oil channels 200-204 can supply control fluid. For example, oil channel 202 can supply control fluid to enable hydraulic lash adjustment in the insert 5, or to enable engine braking or cylinder deactivation functionality, as per the insert 5. Oil channel 200 in valve side latch body 240 of valve side rocker arm portion 12 can supply control fluid to the latch pin assembly 20. Oil channel 201 in cam side latch body 242 can supply a separate control fluid. Oil channels 200-202 connect to receive fluid from the rocker shaft bore 3, and oil channels 203, 204 can be formed for additional functionality, such as an EEVO (early exhaust valve opening) control fluid. The oil channels 200-204 can be drilled or cast or otherwise formed into the rocker arm assembly 10, and in some alternatives plugs 1 can be used to fluidly seal an end of the oil channel, as shown for oil channel 200 in FIG. 1. Or, a controlled leak path can be formed through the plug, as in FIG. 2.

A slot 30 is defined in the cam side rocker arm portion 14. The latch pin assembly 20 engages the slot 30 in a way that is normally latched and allows for lost motion when disengaged, and also engages in a way as referred to herein as partially engaged. Slot 30 comprises on one side, shown in body portion 240 of valve side rocker arm portion 12, a primary oil control cavity 70. On the other side of slot 30, shown in body portion 242 of cam side rocker arm portion 14, a secondary oil control cavity 72 is formed. Latch pin assembly 20 is nested in slot 30 and comprises telescoping aspects to interface with channels 440, 540, 4400, 5400, 701, 722, 1701, 1722 and rims 401, 402, 4010, 4020 to provide at least two valve lift profiles to one or more valves coupled to the rocker arm, and to provide at least three valve lift profiles.

Figure 3:
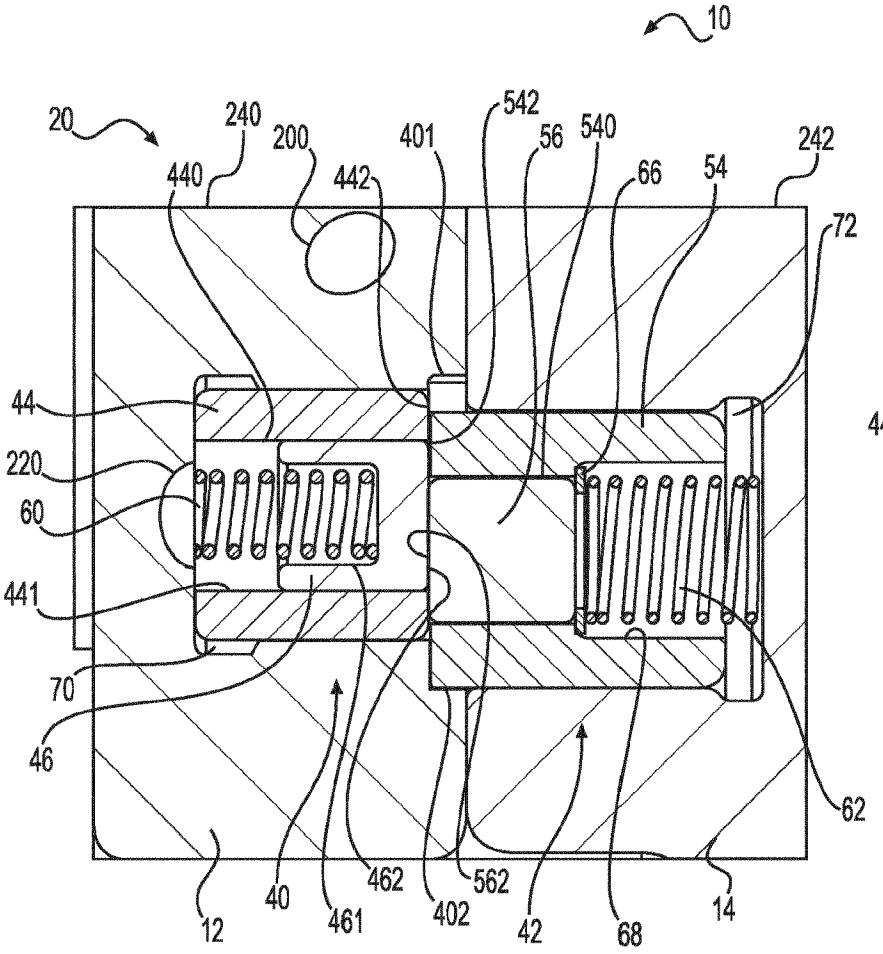
FIG. 3 is a sectional view of the latch pin assembly of FIG. 2 and shown in normal lift.

Referring now to FIG. 3, the latch pin assembly 20 generally includes a primary latch pin assembly 40 and a secondary latch pin assembly 42. The primary latch pin assembly 40 generally includes a first primary pin 44 and a second primary pin 46. The secondary latch pin assembly 42 generally includes a first secondary pin 54 and a second secondary pin 56. A first biasing member 60 urges the second primary pin 46 rightward as viewed from FIG. 3 toward the secondary latch pin assembly 42. A second biasing member 62 urges the first secondary pin 54 leftward as viewed in FIG. 4 toward the primary latch pin assembly 40. A lock ring 66 is positioned in a blind bore 68 that the second biasing member 62 biases against. The primary latch pin assembly 40 nests in a primary oil control cavity 70. The secondary latch pin assembly 42 nests in a secondary oil control cavity 72.

A first end 441 of first primary pin 44 can abut a back wall 1700 of oil control cavity 70 in FIG. 3. A first end 541 of second primary pin 54 can abut back wall 1720 of oil control cavity 72. A second end 442 of first primary pin 44 can abut a second end 542 of second primary pin 54. As shown by comparing the Figures, first primary pin 44 is arranged to telescope in and out of channel 701 of oil control cavity 70 in response to oil pressure from oil channel 200 to gland 220 and in response to opposing pressure from second primary pin 54. Second primary pin 54 can telescope in and out of channel 722 of secondary oil control cavity 72. The second biasing member can be designed with a force to bias second primary pin 54 out of the oil control cavity 72, and further oil control can cause second primary pin 56 to telescope out of secondary channel 540 of second primary pin 54 and towards (FIG. 3) or into (FIG. 4) primary channel 440 in first primary pin 44.

Outward surface 462 of first secondary pin 46 can be biased towards secondary latch pin assembly 42 by first biasing member 60 in a cavity 461. Outward surface 562 of second secondary pin 56 can be biased towards primary latch pin assembly 40 by the second biasing member 62 and by oil pressure to gland communicating with secondary oil control cavity 72. The blind bore 68 can be oil fed by oil channel 201. Lock ring 66 can seat second secondary pin 56. And, secondary pin 56 can be opposed and positioned in secondary channel 540 by oil pressure to second primary pin 46.

Figure 4:
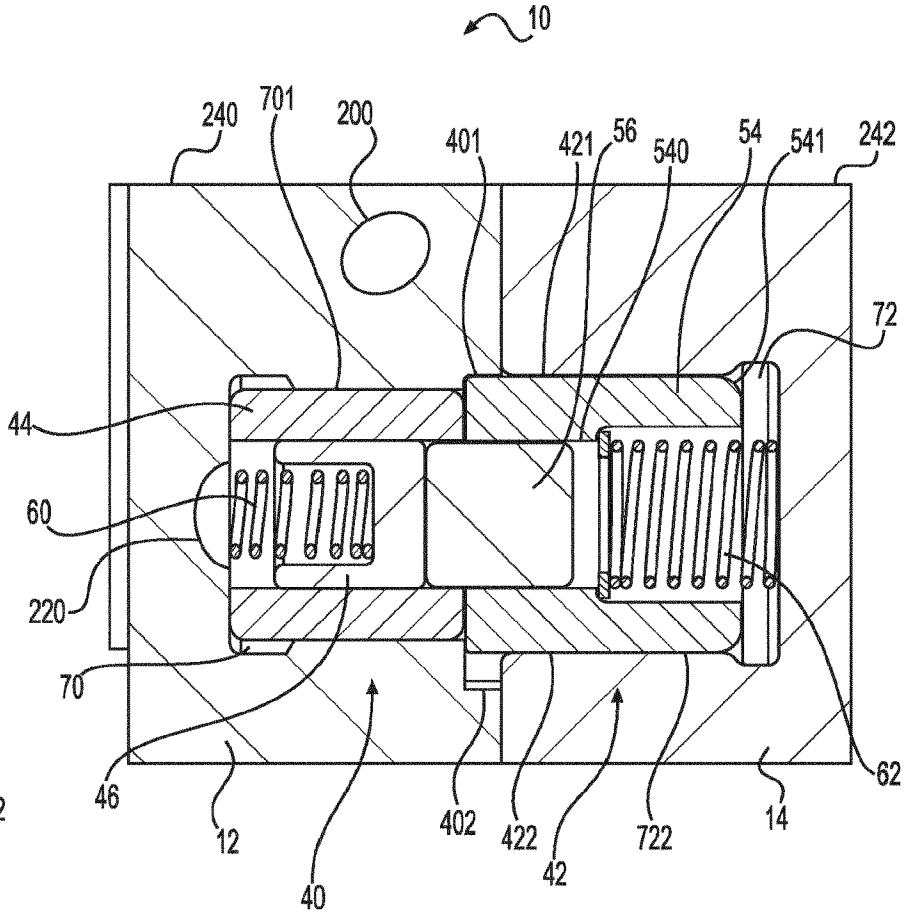
FIG. 4 is a sectional view of the latch pin assembly of FIG. 3 and shown in early exhaust valve opening (EEVO) lift.

With reference to FIGS. 3 and 4, with a primary oil pressure supplied to primary and secondary oil cavities 70, 72, a normal lift mode can be conveyed to a valve affiliated with the rocker arm assembly 10. In normal lift mode, the secondary latch pin assembly 42 can shuttle in rim of channel 701 between a first side 401 and second side 402 of the rim. A cam rolling against roller bearing 9 conveys a valve lift profile to the rocker arm, and the rim profile conveys another attribute of the valve lift profile. In FIG. 4, when pressurized oil is delivered to the secondary oil control cavity 72, then the second secondary pin 56 moves into engagement with the first primary pin 44 by telescoping out of channel 540 and into channel 440 for EEVO lift mode. The secondary latch pin assembly 42, being locked by its telescopic relationship with the second secondary pin, and being travel-limited by the first primary pin 44, cannot shuttle from side to side 401,402 of the rim and is locked adjacent rim 401 in FIG. 4. Thus, at least two valve lift modes are conveyed by controlling the latch pin assembly 20. To add a third valve lift mode, pressurized oil is delivered to the primary oil control cavity 70 and the second secondary pin 56 is caused to retreat rightward. The valve side rocker arm portion 12 and cam side rocker arm portion 14 are permitted to pivot relative to each other in a deactivated lift mode of FIG. 5. The deactivated lift mode can also be called a "lost motion" lift mode or "zero lift" mode because the lift profile from the cam lobe to roller bearing 9 of cam side rocker arm portion 14 is not transferred to the valve side rocker arm portion 12. It is "lost" when the latch pin assembly 20 does not transfer cam lobe motion from the cam side rocker arm portion 14 to the valve side rocker arm portion 12.

Figure 5:
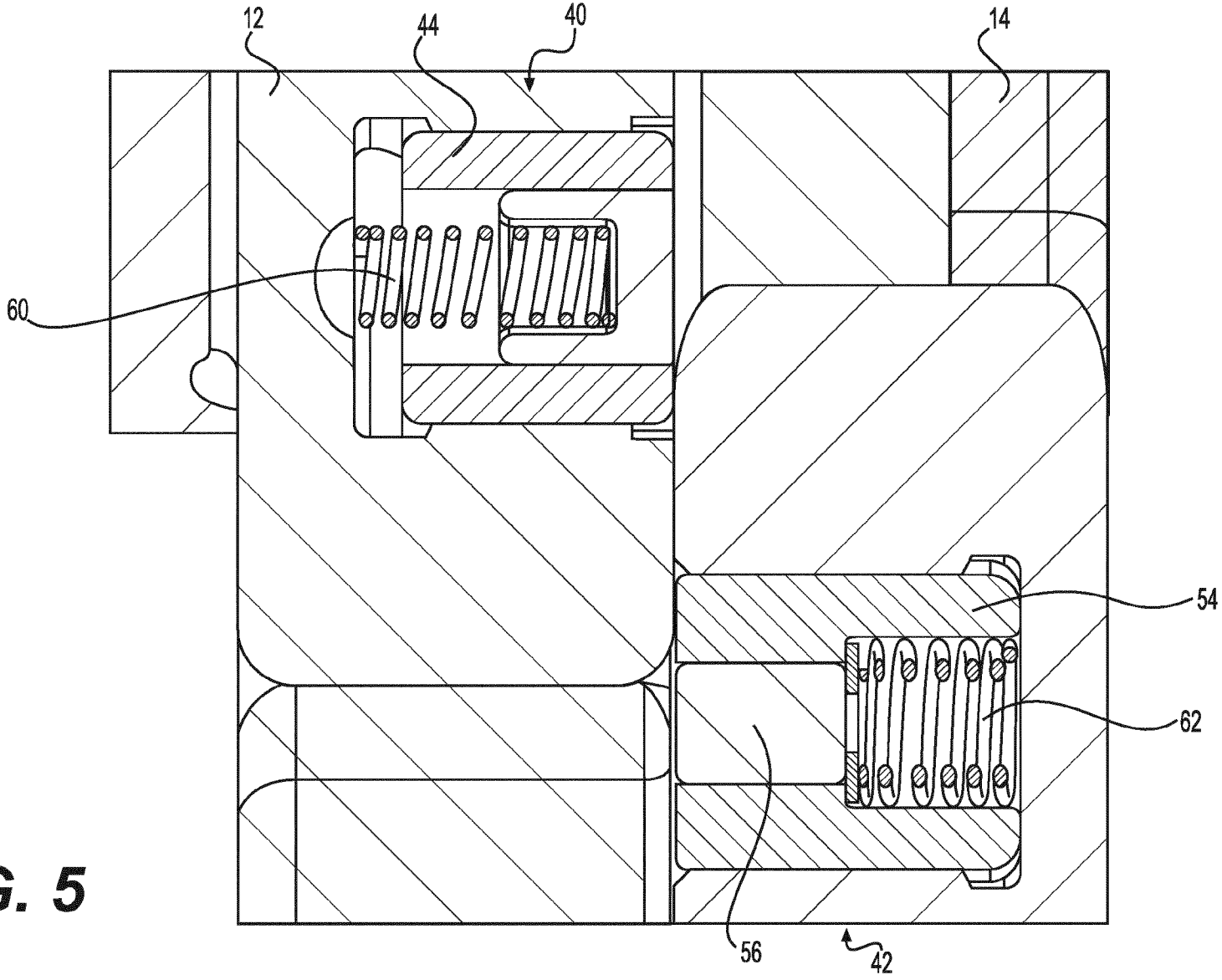
FIG. 5 is a sectional view of the latch pin assembly of FIG. 3 and shown in deactivated lift.
Figure 11:
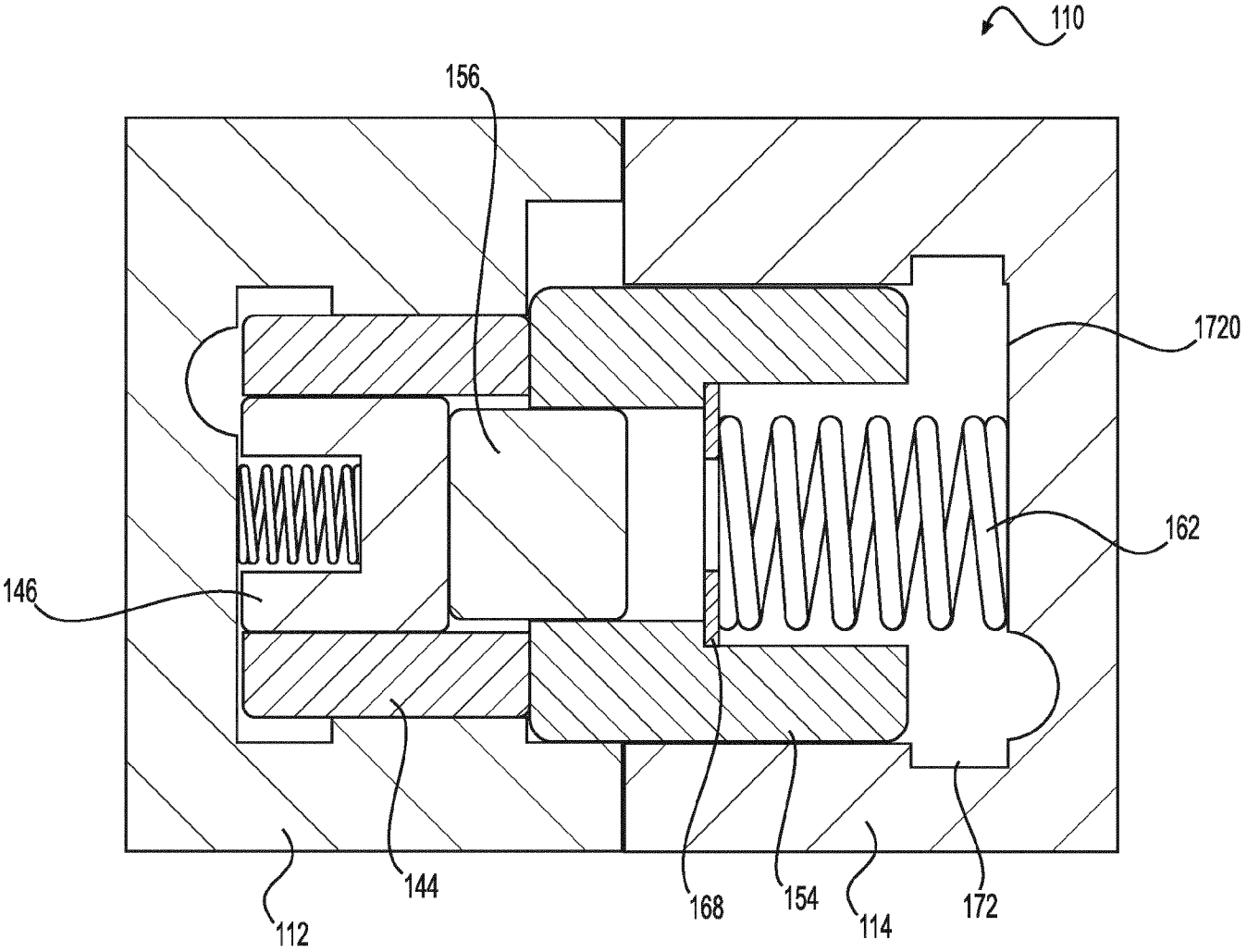
FIG. 11 is a sectional view of the latch pin assembly of FIG. 7 and shown in secondary control active with the latch fully engaged.

Comparing FIGS. 3-5, it can be seen that the rim of channel 701 does not have to be concentric, nor even circular. Side 401 can be closer or farther from a center point of channel 701 than side 402. Side 402 can be distanced more or less away from the center of channel 701 than side 401. Alternatively, the rim can be positioned on the cam side body portion 242 instead of on the valve side body portion 240. Comparing FIGS. 11 & 13, the valve side rocker arm portion 112 is moved relative to the cam side rocker arm portion 114 and this also reveals a benefit of the sides 4010, 4020 of the rim. The rim shape can be controlled to dictate a valve lift profile. When first secondary pins 54, 154 are configured to ride in the rim area during cam side rocker arm portion motion, the shape of the rim can modify the valve lift profile conveyed by the cam lobe 2.

With reference now to FIG. 7-12, a rocker arm assembly constructed in accordance to another example of the present disclosure is shown and generally identified at reference 110. The rocker arm assembly 110 can be constructed similarly to the rocker arm 10 described above wherein similar reference numerals are used to denote similar components. The rocker arm assembly 110 generally includes a valve side rocker arm portion 112 and a cam side rocker arm portion 114. A latch pin assembly 120 moves between various positions to achieve different operating conditions. The latch pin assembly 120 operates as a mechanical latch pin for deactivating the rocker arm assembly 110. In this regard, the rocker arm assembly 110 is capable of full lift, partial lift, or no lift.

Outward surface 1462 of first secondary pin 146 can be biased towards secondary latch pin assembly 142 by first biasing member 160. Outward surface 1562 of second secondary pin 156 can be biased towards primary latch pin assembly 140 by the second biasing member 162 and by oil pressure to gland communicating with secondary oil control cavity 172. The blind bore 168 can be oil fed by oil channel 201. Lock ring 166 can seat second secondary pin 156. And, secondary pin 156 can be opposed and positioned in secondary channel 1540 by oil pressure to second primary pin 146.

Figure 8:
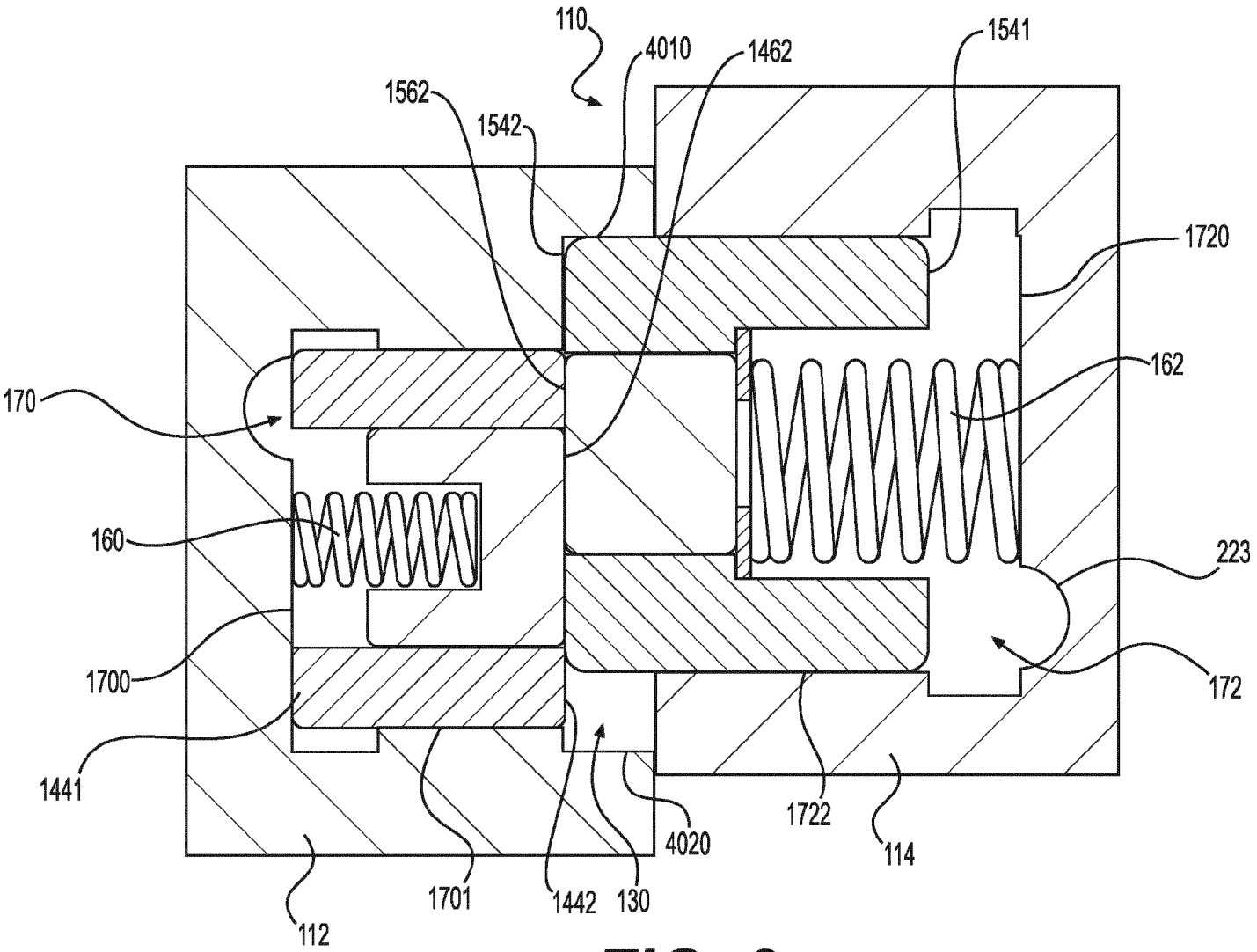
FIG. 8 is a sectional view of the latch pin assembly of FIG. 7 and shown in a normal lift position with the latch partially engaged.
Figure 9:
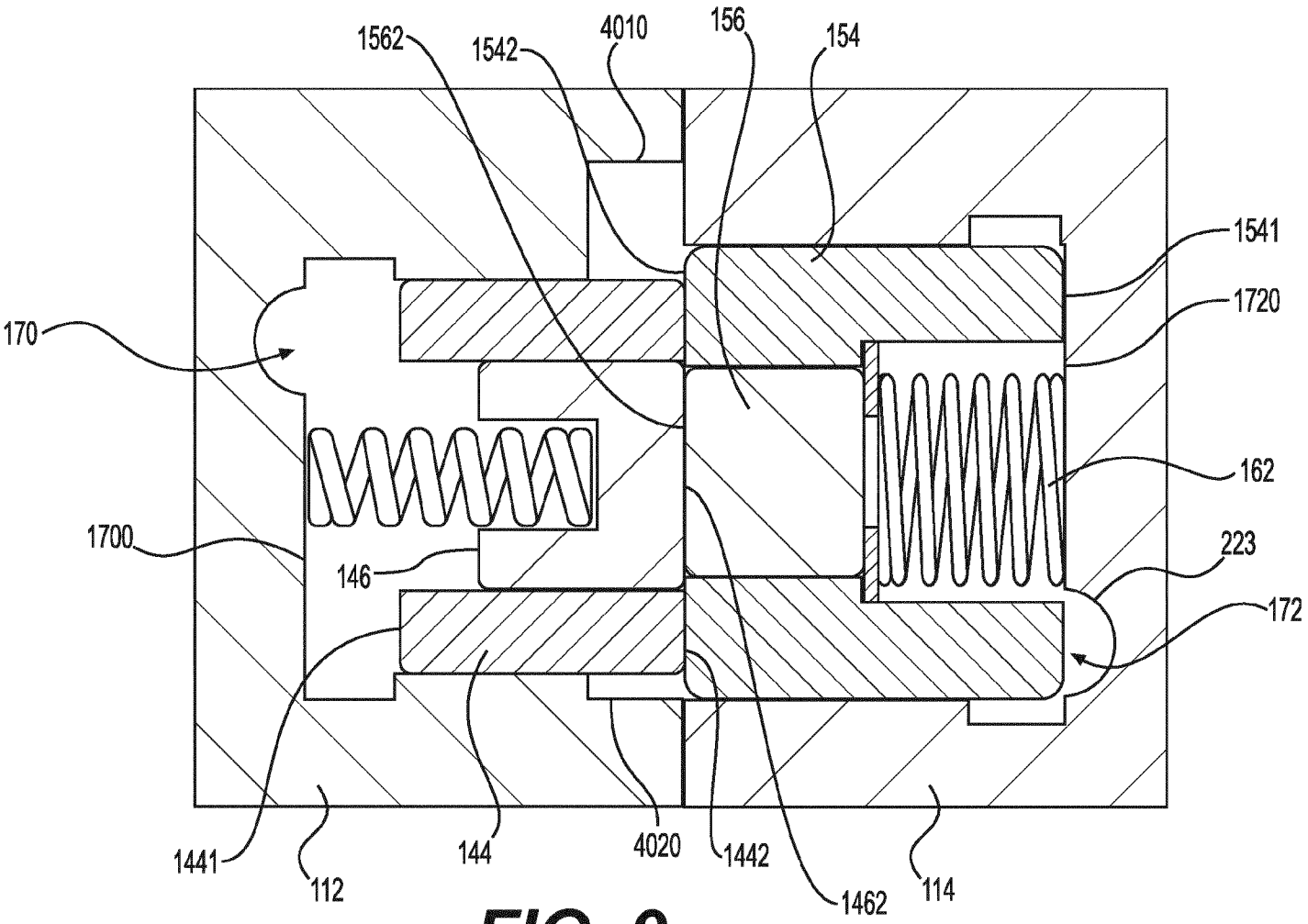
FIG. 9 is a sectional view of the latch pin assembly of FIG. 7 and shown in primary control active with the latch disengaged.

A first end 1441 of first primary pin 144 can abut a back wall 1700 of oil control cavity 170 in FIG. 8. A first end 1541 of second primary pin 154 can be distanced from back wall 1720 of oil control cavity 172 so that second end 1442 of first primary pin 144 can abut a second end 1542 of second primary pin 154. First primary pin 144 can serve as a travel limit for restricting protrusion of secondary latch pin assembly 142 into first latch pin assembly 140.

Figure 6:
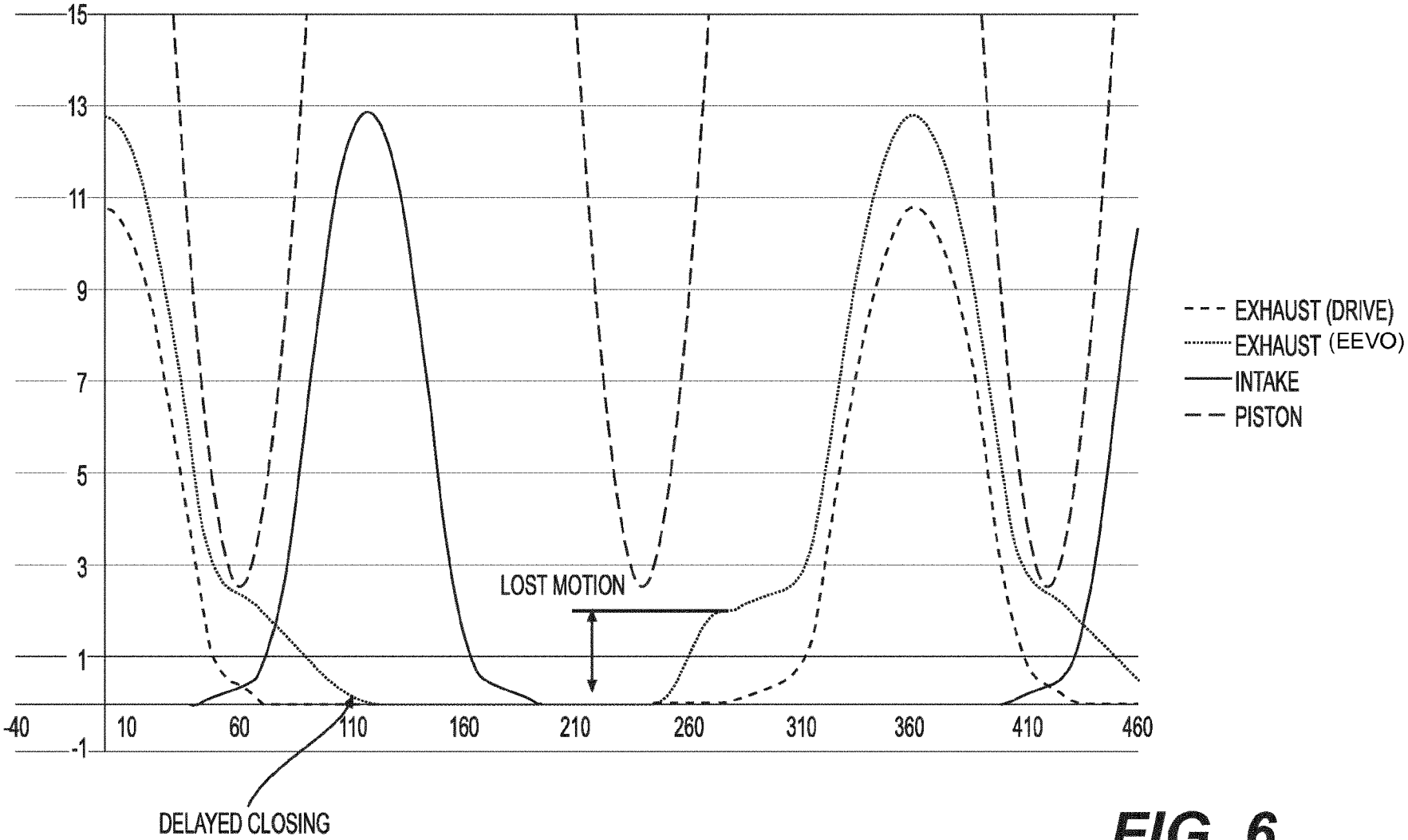
FIG. 6 is a plot illustrating EEVO, DRIVE, & lost motion lift profiles according to one example of the present disclosure.
Figure 7:
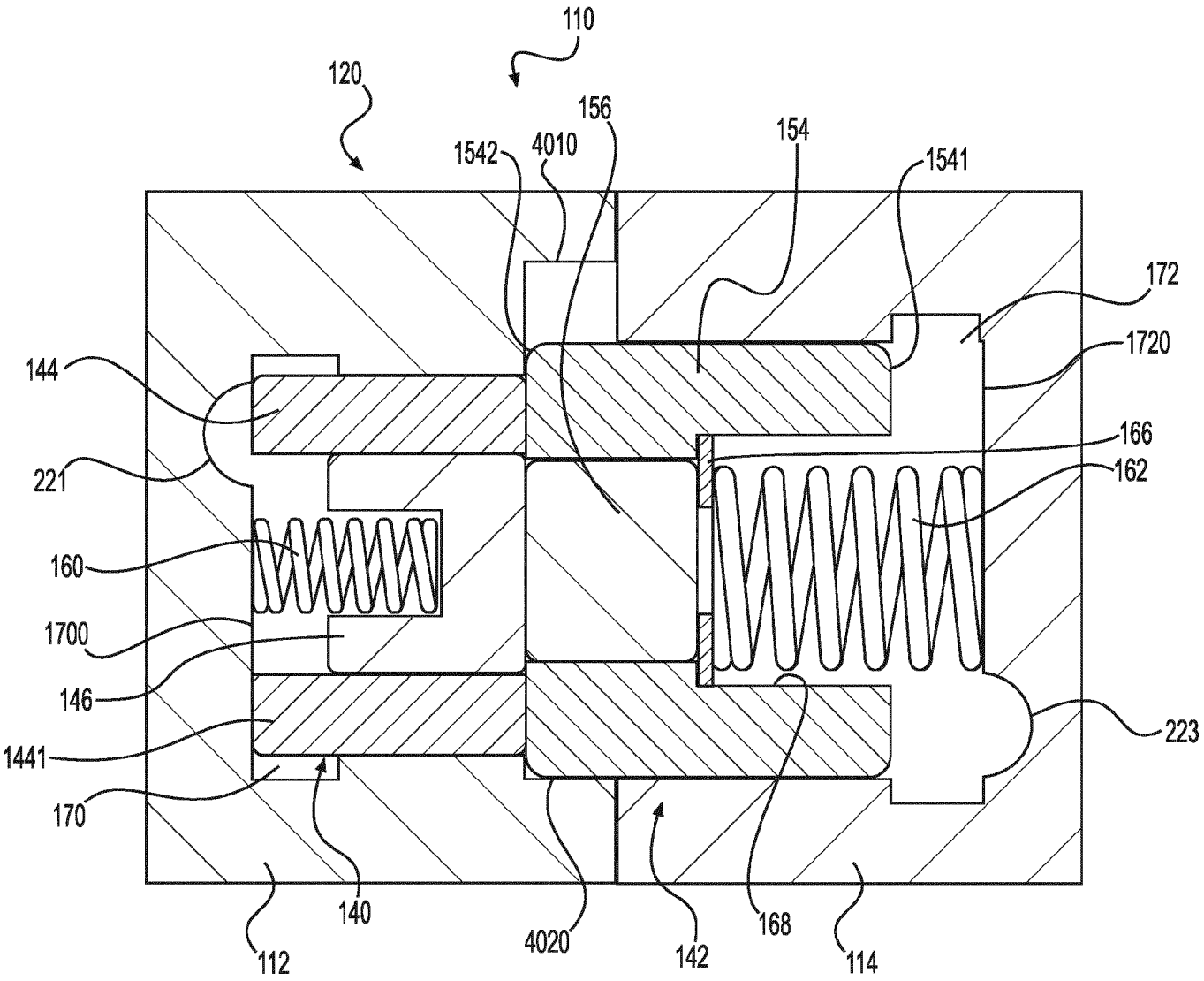
FIG. 7 is a sectional view of a latch pin assembly constructed in accordance to additional features of the present disclosure.

Turning to FIG. 6, the benefits of the rims and latch pin assemblies can be described. A cam profile on a cam lobe 2 can impart a valve lift profile to the rocker arm assemblies 10, 110. Shapes for the cam lobe 2 and set-ups to create a type III center pivot valvetrain can be used to press upon the roller bearing 9, which could alternatively be a tappet. The cam lobe 2 can be designed to impart a designated motion to the cam side rocker arm portion 14, 114. The designated motion can then be modified by controlling the latch assemblies disclosed herein and further modified by the design of the rims. Numerous variable valve actuation (VVA) lift modes become enabled, such as engine braking (EB), cylinder deactivation (CDA), early exhaust valve opening (EEVO), late intake valve closing (LIVC), internal exhaust gas recirculation (iEGR), intake recharge (IRC), among many others.

Figure 12:
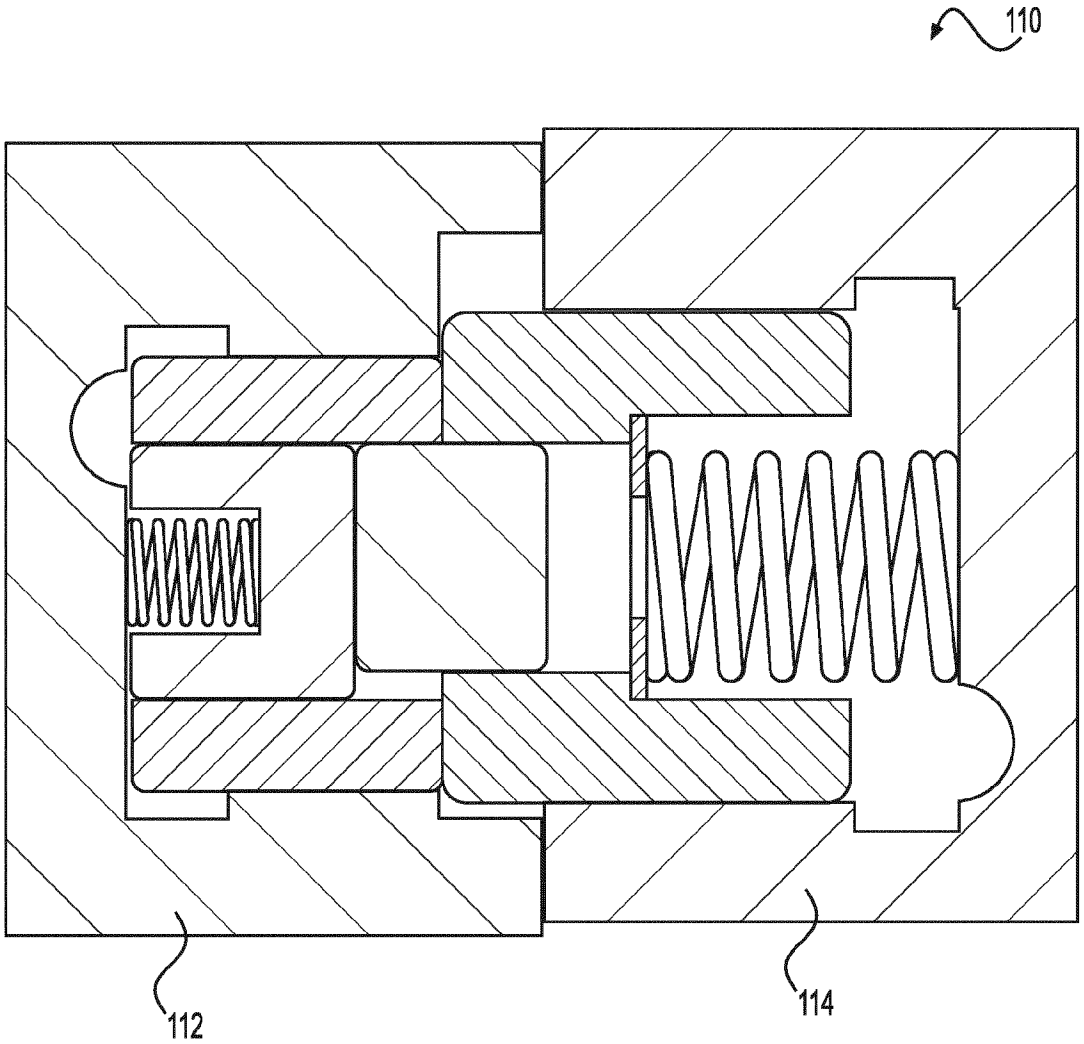
FIG. 12 is a sectional view of the latch pin assembly of FIG. 7 and shown in secondary control active with the latch fully engaged and with the valve side rocker arm portion moved relative to the cam side rocker arm portion.

In reference to FIGS. 4, 6, & 12, a full lift mode, meaning the largest or highest lift imparted by the cam lobe 2 acting on the cam side rocker arm portion 14, 114, is transferred from the cam lobe 2 to the cam side rocker arm portion 14 or 114, through the latch pin assembly and to the valve side rocker arm portion 12, 112. A valve affiliated with the rocker arm assembly 10, 110 would exhibit the EEVO dashed line profile of FIG. 6. At least a portion of the second secondary pin 56, 156 telescopes into at least a portion of the inner channel 440, 1440 of the first primary pin 44, 144. This pushes the second primary pin 46, 146 towards the base 1700 of the primary oil cavity 70. The position of the valve side rocker arm portion 12, 112 is locked with respect to the cam side rocker arm portion 14, 114 and the cam side rocker arm portion 14, 114 transfers all motion from the cam lobe 2. In this example, an EEVO lift profile is transferred that is higher and wider than the DRIVE lift mode shown in FIG. 6.

In reference to FIGS. 3 & 8, another valve lift mode can be a partial lift profile indicated by the dashed DRIVE line in FIG. 6. It can correspond to a "normal" or "nominal" lift mode, although it could also correspond to a low lift mode or other VVA technique and the first lift mode imparted can be designated "normal" or "nominal." In the example, it is desired to "lose" the motion that extends opening of the exhaust valve. So, the rim size and shape is chosen to yield the "lost motion" indicated in FIG. 6. The delayed closing of the exhaust valve, the extra height of the valve lift, and the early opening of the exhaust valve are all aspects that can be "lost" by controlling the latch pin assembly parameters and slot 30 parameters. The secondary latch pin assembly 42, 142 can shift in the rim between sides 401 & 402, 4010 & 4020 so that when the cam lobe 2 presses on the cam side rocker arm portion, that portion of the motion becomes "lost motion." So, the rim can be chosen to subtract from the cam lobe motion when the first secondary pin 54, 154 and second secondary pin 56, 156 ride in the rim. By controlling the spring force of second biasing member 62, 162 and the first biasing member 60, 160, the latch pin assembly can be designed so that the first primary pin 44, 144 and second primary pin 46, 146 are pressed back to reveal the rim absent sufficient oil pressure to gland 220, 221 to overcome spring force of the second biasing member 62,162.

Figure 10:
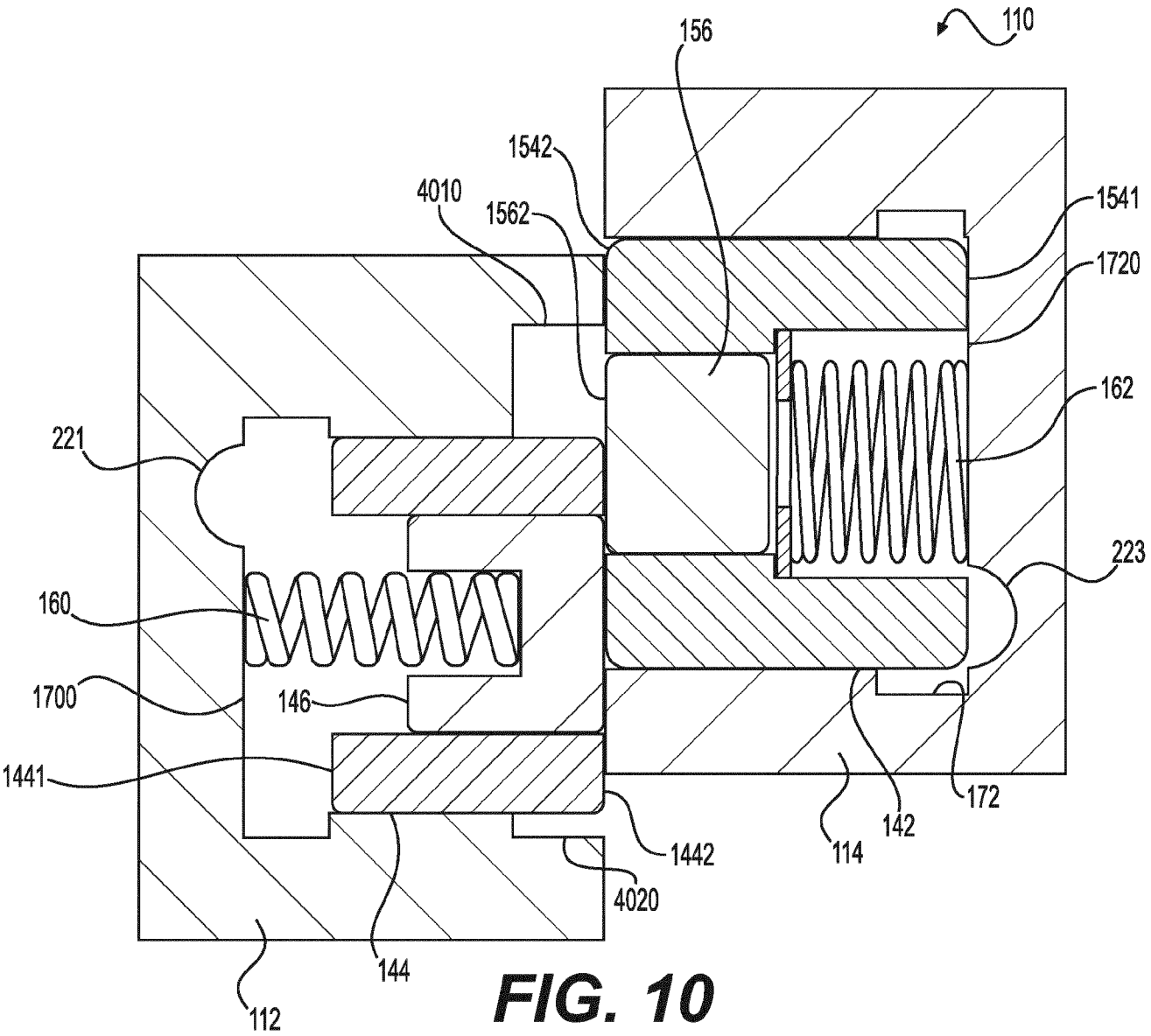
FIG. 10 is a sectional view of the latch pin assembly of FIG. 7 and shown in primary control active with the latch disengaged and with the valve side rocker arm portion moved relative to the cam side rocker arm portion.

Another kind of "lost motion" is shown in FIGS. 5 & 10. In this kind of lost motion, suitable for cylinder deactivation (CDA) lift modes, no cam lobe motion is transferred to the valve side rocker arm portion 12, 112. Oil pressure to oil cavity 70, 170 pushes second primary pin 46, 146 towards secondary latch pin assembly 42. The second primary pin 46, 146 can seat against lock ring 68, 168. When exiting the full lift mode, this can comprise pushing the second secondary pin 56, 156 out of the first primary pin 44, 144 and back into the first secondary pin 54, 154. Oil control to second oil cavity 72, 172 can comprise a low pressure or no pressure condition while oil control for primary oil cavity 70, 170 can comprise a higher oil pressure. First primary pin 44, 144 can also move due to oil pressure to oppose first secondary pin 54, 154 and due to relaxed forces from the secondary latch pin assembly 42, 142. With the secondary latch pin assembly 42, 142 pressed back and nested in secondary oil cavity 72, 172, the cam side rocker arm portion 14, 142 can move without transferring any motion to the valve side rocker arm portion 14, 142. Then, valve motion is deactivated for the affiliated valves.

Other implementations will be apparent to those skilled in the art from consideration of the specification and practice of the examples disclosed herein. The foregoing description has been provided for purposes of illustration. It is not intended to be exhaustive. Individual elements or features of a particular example are not exclusive to that particular example, but, where applicable, are interchangeable and can be used in other examples disclosed.

What is claimed is:

1. A rocker arm assembly comprising:

a valve side rocker arm portion;

a cam side rocker arm portion configured to selectively rotate relative to the valve side rocker arm portion; and a latch pin assembly including a primary latch pin assembly and a secondary latch pin assembly respectively disposed in the valve side rocker arm portion and the cam side rocker arm portion, wherein a combined movement of the primary latch pin assembly and secondary latch pin assembly is configured to selectively switch the rocker arm assembly into a full lift mode, a partial lift mode, and a lost motion lift mode.

2. The rocker arm assembly of claim 1, wherein the valve side rocker arm portion comprises a valve side body including a primary oil control cavity configured to receive the primary latch pin assembly.

3. The rocker arm assembly of claim 2, wherein the primary latch pin assembly comprises a first primary pin nested in the primary oil control cavity, and a second primary pin nested in a channel of the first primary pin such that the primary latch pin assembly is configured to telescopically extend from and retract into the primary oil control cavity.

4. The rocker arm assembly of claim 3, wherein the primary latch pin assembly further comprises a first biasing member configured to bias the second primary pin out of the first primary pin.

5. The rocker arm assembly of claim 3, wherein the cam side rocker arm portion comprises a cam side body including a secondary oil control cavity configured to receive the secondary latch pin assembly, and wherein the secondary latch pin assembly comprises a first secondary pin nested in the secondary oil control cavity, and a second secondary pin nested in a channel of the first secondary pin such that the second secondary pin is configured to telescopically extend out of the channel of the first secondary pin and into the channel of the first primary pin.

6. The rocker arm assembly of claim 2, wherein the valve side body comprises an oil channel configured to supply oil pressure to the primary oil control cavity.

7. The rocker arm assembly of claim 1, wherein the cam side rocker arm portion comprises a cam side body including a secondary oil control cavity configured to receive the secondary latch pin assembly.

8. The rocker arm assembly of claim 7, wherein the secondary latch pin assembly comprises a first secondary pin nested in the secondary oil control cavity, and a second secondary pin nested in a channel of the first secondary pin such that the secondary latch pin assembly is configured to telescopically extend from and retract into the secondary oil control cavity.

9. The rocker arm assembly of claim 8, wherein the secondary latch pin assembly further comprises a second biasing member configured to bias the first secondary pin out of the cam side rocker arm portion.

10. The rocker arm assembly of claim 7, wherein the cam side body comprises an oil channel configured to supply oil pressure to the secondary oil control cavity.

11. The rocker arm assembly of claim 10, wherein the secondary oil control cavity comprises a gland configured to receive the oil pressure.

12. The rocker arm assembly of claim 10, wherein the valve side rocker arm portion comprises a rim around the primary latch pin assembly, and wherein the secondary latch pin assembly is configured to selectively extend out of the cam side rocker arm portion and into the rim.

13. The rocker arm assembly of claim 10, wherein a portion of the secondary latch pin assembly is configured to selectively extend out of the cam side rocker arm portion and into a portion of the primary latch pin assembly.

14. The rocker arm assembly of claim 1, wherein the primary latch pin assembly is configured to pivot past the secondary latch pin assembly when in the lost motion lift mode.

15. A rocker arm assembly comprising:

a valve side rocker arm portion;

a first primary pin nested in the valve side rocker arm portion and a second primary pin nested in the first primary pin, the second primary pin configured to selectively extend and retract within the first primary pin;

a cam side rocker arm portion configured to selectively rotate relative to the valve side rocker arm portion; and a first secondary pin nested in the cam side rocker arm portion and a second secondary pin nested in the first secondary pin, the second secondary pin configured to selectively extend out of and retract within the first secondary pin, wherein the first primary pin and the second primary pin oppose the first secondary pin and the second secondary pin, and wherein one or more of the first primary pin, the second primary pin, the first secondary pin, and the second secondary pin are controlled to selectively switch the rocker arm assembly into a full lift mode, a partial lift mode, and a lost motion lift mode.

16. The rocker arm assembly of claim 15, wherein a portion of the second secondary pin is configured to selectively extend out of the first secondary pin and into a portion of the first primary pin.

17. The rocker arm assembly of claim 15, wherein a portion of the second secondary pin is configured to selectively extend out of the first secondary pin and into a rim of the valve side rocker arm portion.

18. A rocker arm assembly comprising:

a valve side rocker arm portion;

a primary latch pin assembly nested in the valve side rocker arm portion and biased to selectively extend in the valve side rocker arm portion;

a cam side rocker arm portion configured to selectively rotate relative to the valve side rocker arm portion; and a secondary latch pin assembly nested in the cam side rocker arm portion and biased to oppose the primary latch pin assembly, the secondary latch pin assembly configured to selectively extend out of and retract within the cam side rocker arm portion, wherein a combined movement of the primary latch pin assembly and secondary latch pin assembly is configured to selectively switch the rocker arm assembly into a full lift mode, a partial lift mode, and a lost motion lift mode.

* * * * *